US010940070B2

(12) United States Patent
Miller

(10) Patent No.: US 10,940,070 B2
(45) Date of Patent: Mar. 9, 2021

(54) PERSON TRANSFER DEVICE

(71) Applicant: Paul David Miller, Louisville, OH (US)

(72) Inventor: Paul David Miller, Louisville, OH (US)

( * ) Notice: Subject to any disclaimer, the term of this patent is extended or adjusted under 35 U.S.C. 154(b) by 118 days.

(21) Appl. No.: 16/236,908

(22) Filed: Dec. 31, 2018

(65) Prior Publication Data

US 2020/0206055 A1 Jul. 2, 2020

(51) Int. Cl.
*A61G 7/10* (2006.01)

(52) U.S. Cl.
CPC ..... *A61G 7/1036* (2013.01); *A61G 7/103* (2013.01); *A61G 7/1038* (2013.01); *A61G 7/1044* (2013.01); *A61G 7/1076* (2013.01)

(58) Field of Classification Search
CPC ..... A61G 7/00; A61G 13/00
See application file for complete search history.

(56) References Cited

U.S. PATENT DOCUMENTS 2,757,388 A 7/1953 Chisholm
2,963,713 A 3/1959 Forrest
4,829,612 A 5/1989 Adams
4,934,003 A * 6/1990 Hayakawa ..... A61G 7/1017 297/DIG. 10
5,054,137 A 10/1991 Christensen
5,079,789 A 1/1992 Jandrakovic
5,507,044 A 4/1996 Williamson et al.
5,524,303 A 6/1996 Palmer, Jr. et al.
5,526,541 A 6/1996 Massey et al.
5,560,053 A 10/1996 Mills
6,058,527 A 5/2000 Charpin
6,119,287 A 9/2000 Phillips
6,742,201 B2 * 6/2004 Porcheron ..... A61G 7/1019 5/81.1 R (Continued)

FOREIGN PATENT DOCUMENTS

SE 509897 C2 11/1995

OTHER PUBLICATIONS

Copyright 2018, accessed Jul. 19, 2018, Saturn 2 Transfer Disc—NRS Healthcare.

*Primary Examiner* — Sunit Pandya
(74) *Attorney, Agent, or Firm* — Zollinger & Burleson Ltd.

(57) ABSTRACT

A transfer device is used to help a person move from one seated position at a first location to another seated position at a second location. The device is particularly useful for persons who cannot use their legs because the device is structurally supported to allow the person using the device to support himself by his arms and upper body muscles. The device is supported by the floor joists disposed below the floor. The person can have multiple support frames installed at different locations in his house so that the device can be moved from place to place as needed. Each location only requires a small hole to be cut in the floor with the unused holes being closed by plugs. The device allows the person to place his feet on a pivot disc while bracing his knees or shins against a knee board. The person then grasps handgrips and secures his forearms in an arm support assembly and lifts his lower body out of the first location. Another assistant rotates the device to align the person with the second seat wherein the person can lower himself into the second seat.

20 Claims, 9 Drawing Sheets

(56) References Cited

U.S. PATENT DOCUMENTS

| | | | | |
|---|---|---|---|---|
| 7,191,477 | B2 | 3/2007 | Hahn et al. | |
| 7,543,341 | B1 | 6/2009 | Carbaugh | |
| 8,302,221 | B1 | 11/2012 | Camp, Jr. | |
| 8,661,579 | B2 | 3/2014 | Orrico et al. | |
| 2003/0056447 | A1* | 3/2003 | O'Brien ..... | A61H 3/00 52/127.2 |
| 2009/0283360 | A1 | 11/2009 | Eckerdt | |
| 2010/0319121 | A1 | 12/2010 | Polomsky et al. | |
| 2013/0269102 | A1 | 10/2013 | Raven | |
| 2014/0042783 | A1 | 2/2014 | St. Pierre et al. | |
| 2015/0250674 | A1 | 9/2015 | Moore | |
| 2017/0156959 | A1 | 6/2017 | Domenick | |
| 2018/0161224 | A1 | 6/2018 | Forro | |

* cited by examiner

PERSON TRANSFER DEVICE

BACKGROUND OF THE DISCLOSURE

1. Technical Field

The disclosure relates generally to devices used to help a person move from one location to another and, more particularly, to devices used to help a person move from one sitting location such as a chair, couch, or bed to another sitting location such as a wheelchair that is placed near the transfer device. Specifically, the disclosure relates to a transfer device that provides an upper body support that is removably and replaceably supported from a frame connected under the floor to the floor joists. The person pulls himself onto the transfer device using upper body strength at which time the transfer device is rotated to be aligned with another seat at which time the person can lower himself into the seat.

2. Background Information

Different types of devices are known in the art for assisting a person's movement from one seated position to another. Many of these known devices provide a platform on which a person stands while holding himself steady with a hand support. The person himself or another person then moves or rotates the standing person and device to align the person with the target seat. The person then lowers himself into the seat. Although these device are useful for people who can stand during the process, the devices cannot be used by those people who cannot use their legs. Another limitation with some known devices is that the person charged with moving and/or rotating the person on the device must support some of the weight and use strength to control the device to prevent it from tipping over.

Another drawback with some prior art devices is that they merely sit on a floor surface and can be tipped over if the person loses his balance or tries to pull himself up from the seated position with his arms without first securing the lower foot platform. With people who cannot use their legs, such devices are useless because these people must provide their movement with their arms and upper body strength.

Other devices have drawbacks in that they require an assistant to pull the person up onto the transfer device or at least counterbalance the device against tipping.

SUMMARY OF THE DISCLOSURE

The disclosure provides a transfer device that is used to help a person move from one seated position to another seated position. The device is particularly useful for persons who cannot use their legs because the device is structurally supported to allow the person using the device to support himself by his arms and upper body muscles. The device can be used by males and females with the exemplary person being described as male in the following description and drawings.

The device is supported by the floor joists disposed below the floor. The person can install multiple support frames at different locations in his house so that the device can be moved from place to place as needed. Each location only requires a single hole to be cut in the floor at the location where the device is to be used. Unused holes can be closed by plugs.

The device does not require the person to stand or support himself with his legs in order to use the device. The device allows the person to place his feet on a pivot disc while bracing his knees or shins against a knee board. The person then grasps handgrips and secures his forearms in an arm support assembly and lifts his lower body out of the first location. An assistant rotates the person and upper portions of the device to align the person with the second seat wherein the person can lower himself into the second seat. The assistant to the person does not have to lift the weight of the person or counterbalance the device.

The disclosure also provides a method of transferring a person from a first seated position at a first location to a second seated position at a second location. The method includes the step of moving a wheelchair up to the transfer device and moving or removing the footrests of the wheelchair. The arm rests of the wheelchair are lifted and the wheelchair brakes are engaged. The person places his feet on the pivot disc while placing his arms at one of the positions defined by the upper arm support assembly. The person then grasps the hand grips and places his knees against the knee board. The person then pulls himself up just enough to lift his lower body off the chair/couch/bed while an assistant swivels the device to a position aligned with the wheelchair. The person lowers himself onto wheelchair seat. The armrests are lowered, the brake is disengaged, and the wheelchair is moved away from transfer device. The assistant or the person can then replace the footrests.

The device includes an upper body support that provides multiple potential positions and grips for the person's arms. The upper body support provides an open center portion that allows the person to lean into the support.

The disclosure provides embodiments wherein the upper body support and knee board pivot on a support post and another configuration wherein the upper body support and knee board rotate with the support post.

The preceding non-limiting aspects, as well as others, are more particularly described below. A more complete understanding of the device and methods can be obtained by reference to the accompanying drawings, which are not intended to indicate relative size and dimensions of the assemblies or components thereof. In those drawings and the description below, like numeric designations refer to components of like function. Specific terms used in that description are intended to refer only to the particular structure of the embodiments selected for illustration in the drawings, and are not intended to define or limit the scope of the disclosure.

DETAILED DESCRIPTION OF THE DISCLOSURE

Figure 1:
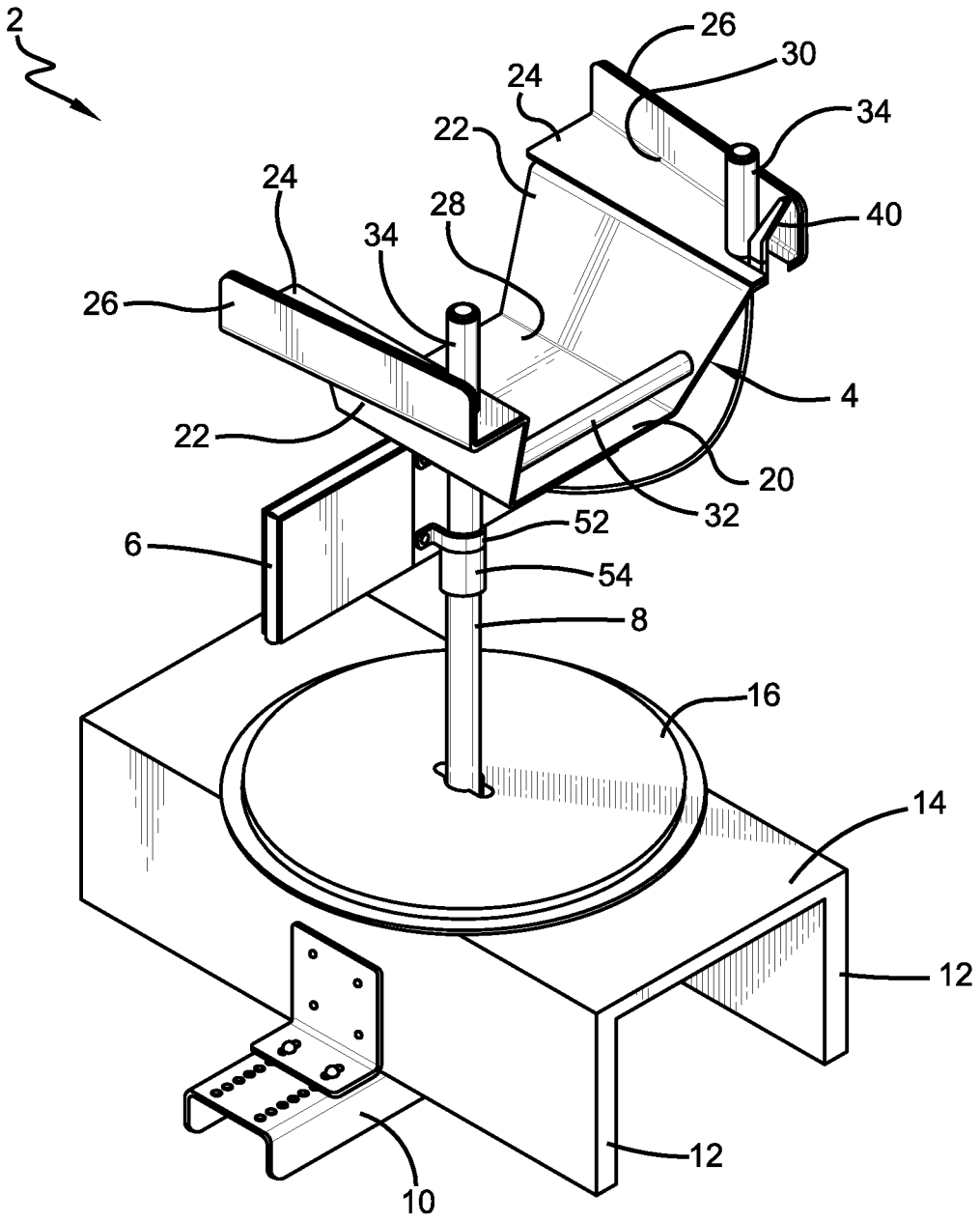
FIG. 1 is a perspective view of an exemplary configuration for the transfer device of the disclosure with most of the floor and the floor covering removed to depict the connection between the device and the floor joists.
Figure 2:
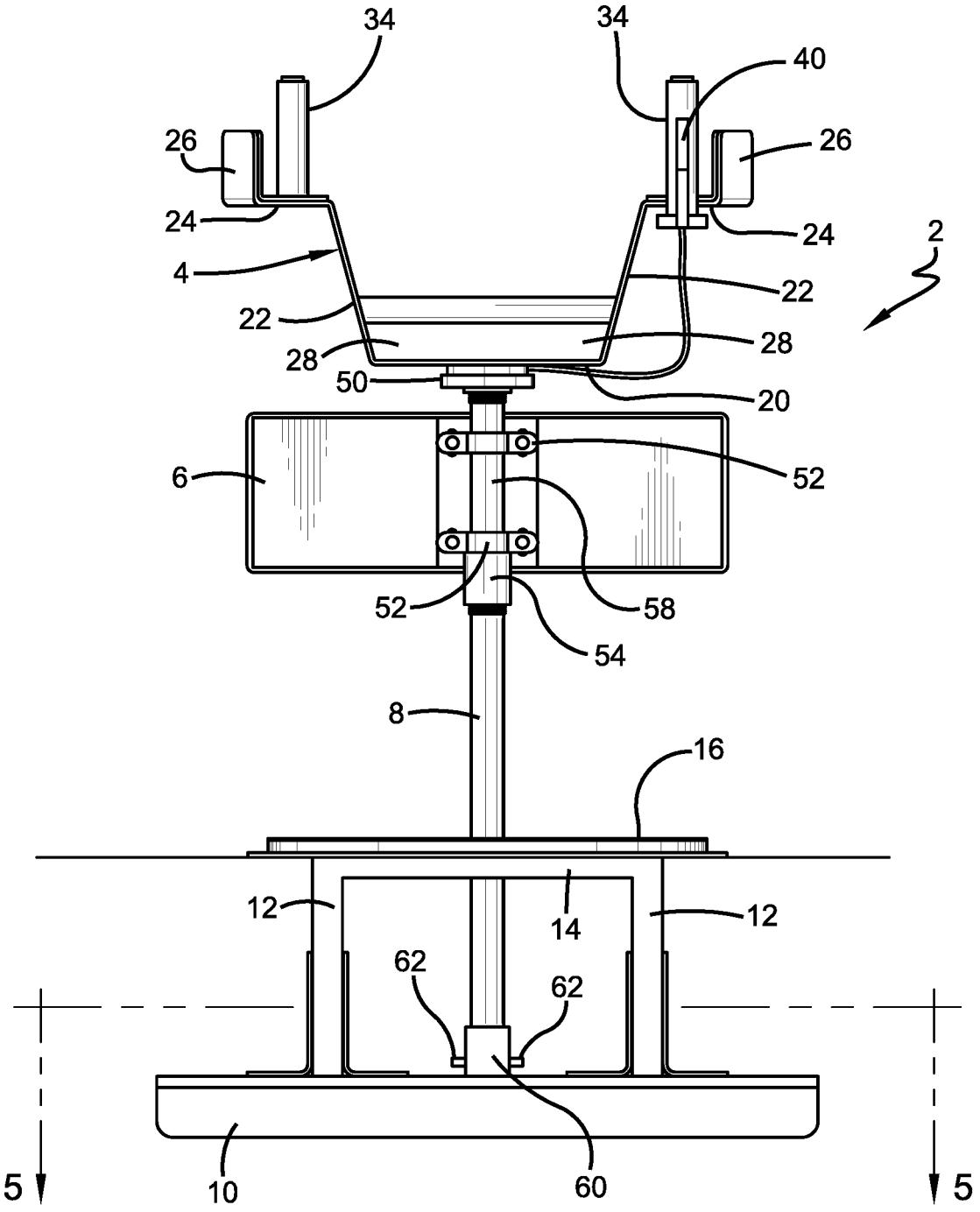
FIG. 2 is a rear elevation view of the device of FIG. 1.
Figure 3:
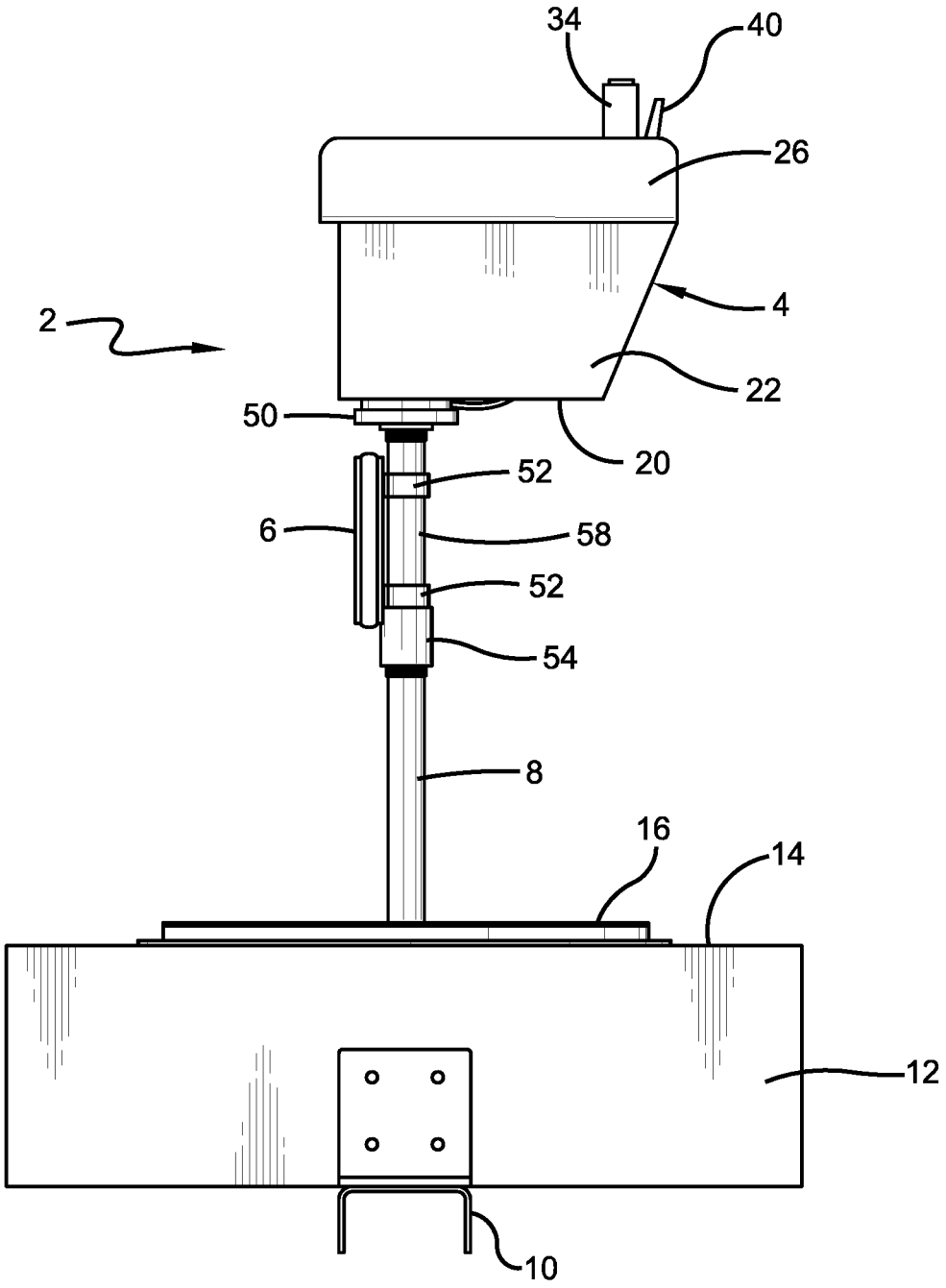
FIG. 3 is a side elevation view of the device of FIG. 1.
Figure 4:
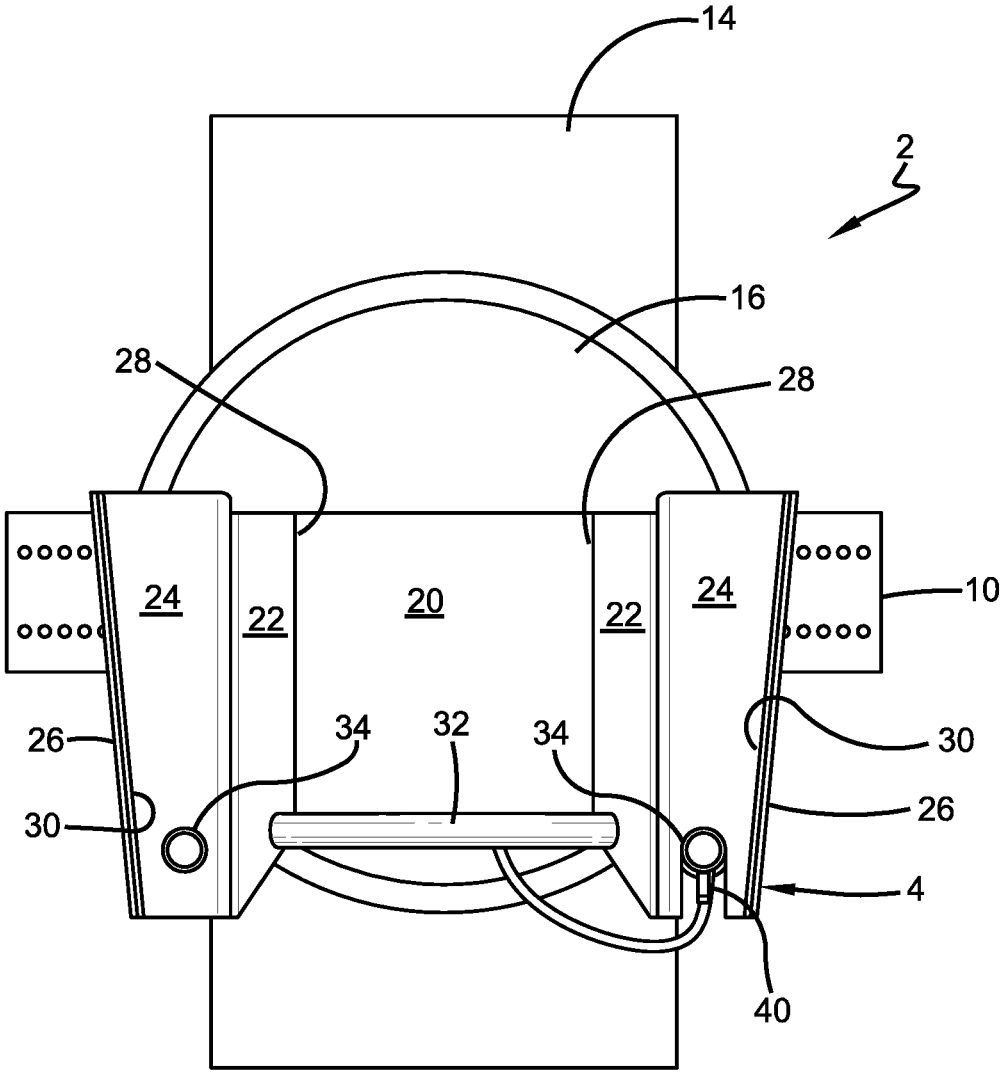
FIG. 4 is a top plan view of the device of FIG. 1.
Figure 5:
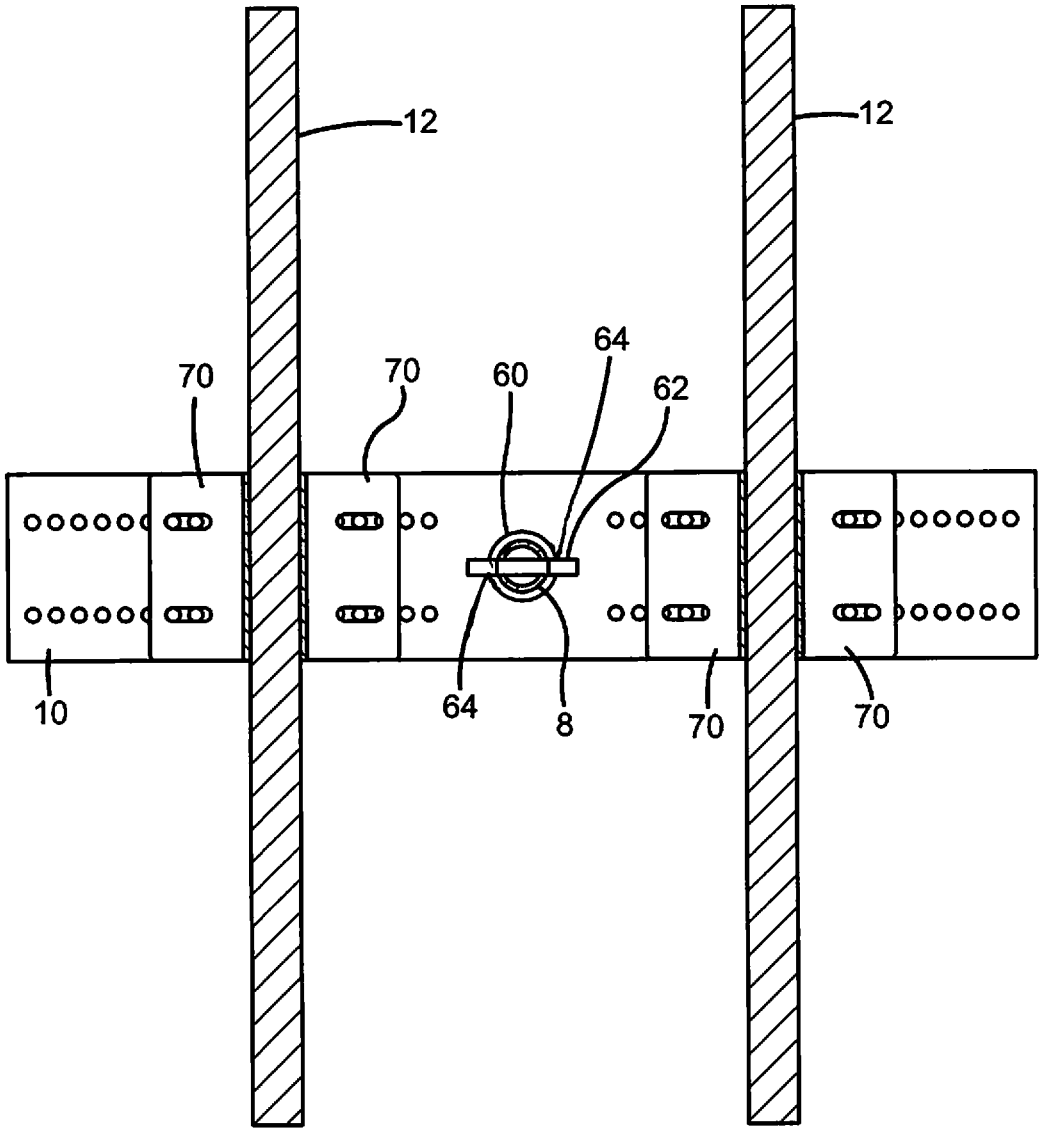
FIG. 5 is a section view taken along line 5-5 of FIG. 2.

An exemplary configuration of a person transfer device is indicated generally by the reference numeral 2 in the accompanying drawings. Device 2 is used to move a person from one seated position at a first location to a second seated position at a second location that is rotationally spaced from the first position. During use, device 2 is secured to a structural support and, as such, is not used to move the person across a room. Device 2 is particularly useful for transferring a person from a first seated position in a chair, couch, or bed to a second seated position in a wheelchair. The person being moved does not need to support himself with his legs during the process and an assistant need only rotate the device to move the person from the first location to the second location without needing to lift the person or counterbalance device 2 during the process. The person being moved supports himself with his upper body during the transfer.

Device 2 generally includes an upper body support 4 and knee board 6 carried by a support post 8. Support post 8 is supported by a support frame 10 that is secured to first and second floor joists 12 disposed below the floor 14 on which device 2 is used. A pivot disc 16 is disposed about support post 8 and on top of floor 14. In this context, floor 14 includes the subflooring material, the main flooring material, a floor covering (such as carpet), or any combination of these items. Upper body support 4 can be fabricated from aluminum to reduce the overall weight of device 2. Knee board 6 also can be made from aluminum with cushioning pads. Support post 8 and support frame 10 are made from steel. Pivot disc 16 includes an upper layer which slides against a lower layer (one can be an ultra-high molecular weight polyethylene) or an upper layer which rides on ball bearings carried by the lower layer.

In order to install device 2, a hole is cut through floor 14 at the desired location of use. Only a single hole is needed and device 2 is installed without requiring fasteners to be secured to the flooring around device 2. The hole is cut between floor joists 12 and at a location with no air ducts, electrical wiring, or plumbing. A person's home can be provided with multiple holes and support frames 10 at different locations throughout the home where the person needs to use device 2. The upper portions (4, 6, and 8) of device 2 can then be moved from location to location as it is needed. Each unused hole can be covered with a plug. Device 2 is installed and ready to use simply by inserting the lower end of support post 8 through the hole to engage support frame 10.

Upper body support 4 generally includes a bottom wall 20, a pair of lower outer walls 22, a pair of upper shelfs 24, and a pair of upper outer walls 26. These walls are configured to define lower 28 and upper 30 arm supports into which the person being moved can place his forearms when using device 2. Lower arm supports 28 are defined at the corners between bottom wall 20 and lower outer walls 22. Upper arm supports 30 are defined at the corners between upper shelfs 24 and upper outer walls 26.

Lower outer walls 22 diverge from one another as they extend up from bottom wall 20 such that their upper edges are spaced farther from one another than their lower edges. This provides an open central area to upper body support 4 that receives a portion of the person's torso during use. A lower, horizontal grip bar 32 extends between, is connected to, and supports lower outer walls 22. Horizontal grip bar 32 is spaced up from bottom wall 20 to provide space for the person's thumbs when the person is grasping bar 32. Horizontal grip bar 32 can be padded with a foam rubber.

Figure 7:
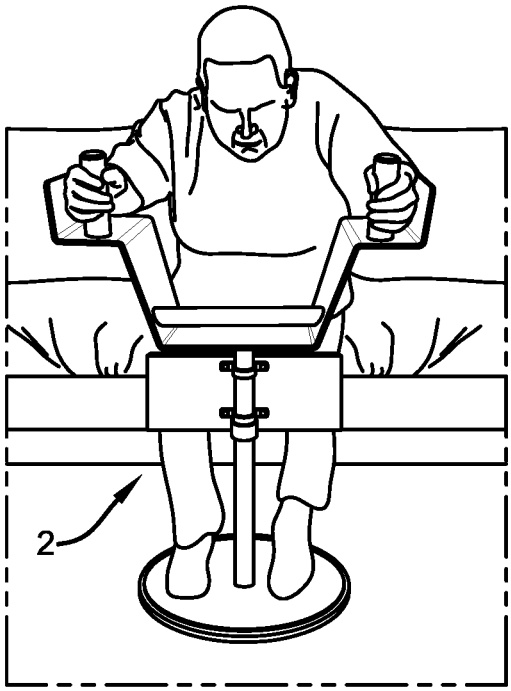
FIG. 7 is a head on view of FIG. 6.
Figure 8:
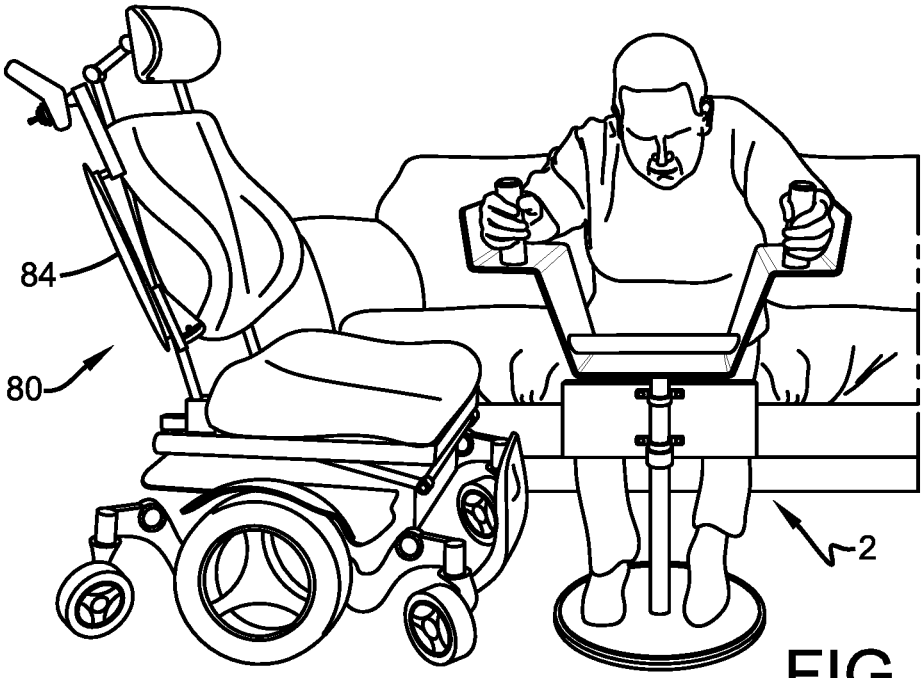
FIG. 8 is a head on view of a second position wherein the person being transferred is supporting himself on the device with his arms and upper body.
Figure 9:
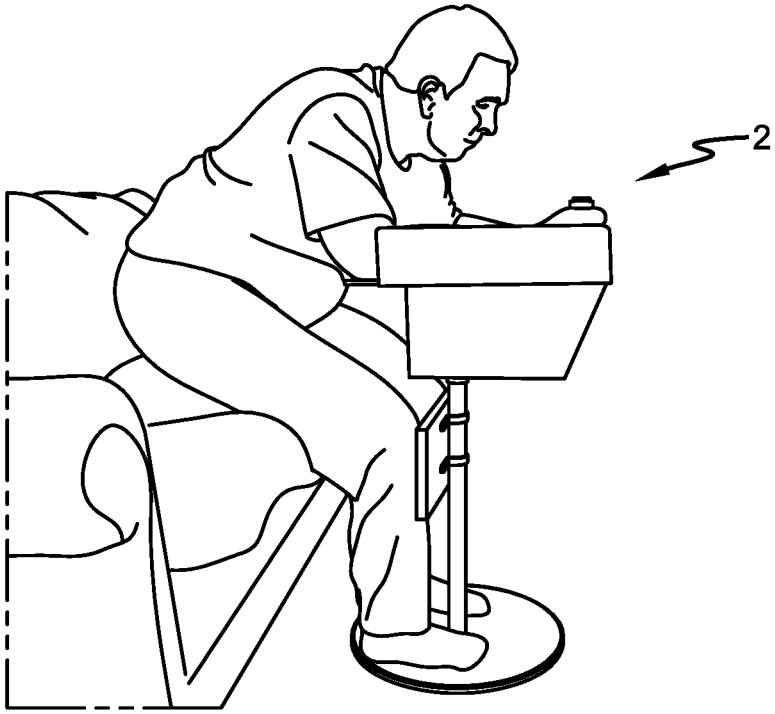
FIG. 9 is a side view of FIG. 8.
Figure 10:
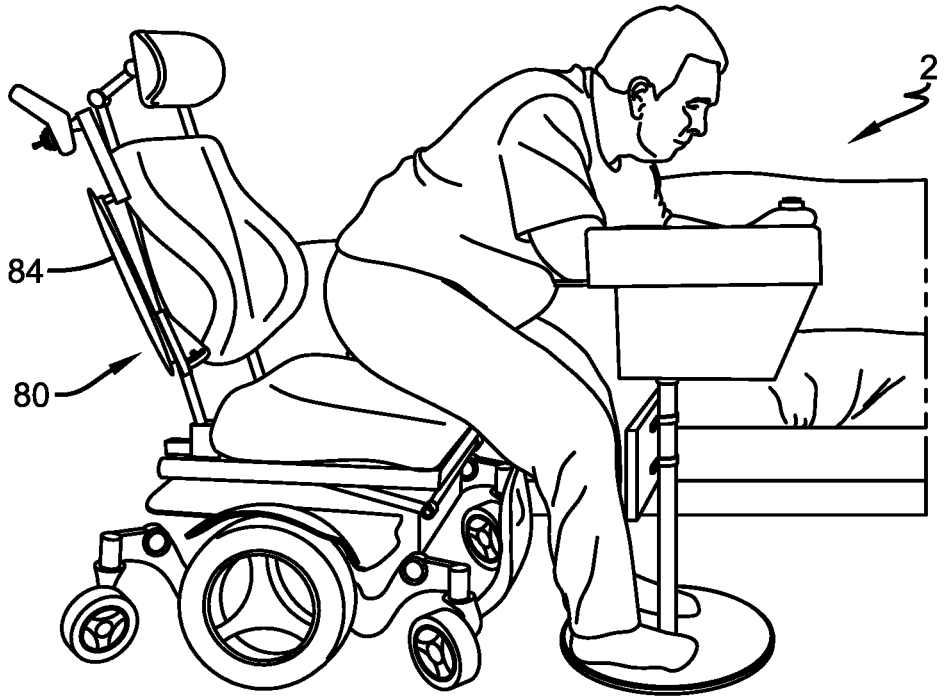
FIG. 10 is a side view of the person after the device has been rotated from the couch to an aligned position with the wheelchair.

An upper grip 34 is disposed vertically at the end of each upper shelf 24. Each upper grip 34 can be padded with a foam rubber. Upper outer walls 26 converge toward grips 34 such that their front edges (edges closes to the person being transferred) are spaced farther apart than their rear edges (edge close to grips 34). This orientation defines a V-shaped support for upper arm supports which matches the orientation of the person's forearms when his hands are grasping grips 34 and his forearms are disposed on shelfs 24 and pressing outwardly against upper outer walls 26 as shown in FIGS. 7 and 8.

A hand brake 40 (schematically in FIG. 1) is optionally provided next to one or more grips 32 and 34 to allow the person to lock and release the rotation of upper body support 4. Hand brake 40 can be configured to allow rotation when squeezed toward grips 32 or 34 and then lock rotation when released. Alternatively, hand brake 40 can be configured to prevent rotation of upper body support 4 when squeezed and allow the rotation when released.

In one configuration, upper body support 4 is carried at the top of support post 8 on a turntable 50 that provides frictional rotation or rotation on ball bearings. In this configuration, upper body support 4 rotates with respect to support post 8. In another alternative configuration, upper body support 4 is connected to support post 8 with a non-rotatable connection such that upper body support 4 and support post 8 rotate together with respect to support frame 10 (without pin 62).

As above, knee board 6 is either rotatably connected to support post 8 or connected such that knee board 6 rotates with support post 8. Knee board 6 is connected to support post 8 with a pair of bands 52. In the configuration wherein knee board 6 rotates with support post 8, bands 52 secure knee board 6 to support post 8. In the configuration shown in the drawings, bands 52 rotate with respect to support post 8. The lower band 52 rests on a collar 54. Shims can be added on top of collar 54 to raise the position of knee board 6.

Both sides of knee board 6 are padded to allow both sides of knee board 6 to be used. Both sides can be used by rotating knee board 6 around to the other side of support post 8 which adjusts the depth of knee board 6 by at least the diameter of support post 8 with respect to the position of the person using device 2.

In the configuration depicted in the drawings, support post 8 includes a post extension 58. In this configuration, knee board 6 rotates around post extension 58 which is connected to support post 8 at collar 54 such that extension 58 is secured to support post 8. Post extension 58 can be replaced in different lengths to provide different heights for different seats, for different joist 12 heights, and for people with different heights. Post extension 58 is threaded into collar 54.

Support post 8 is supported by support frame 10 under floor 14. In the exemplary configuration which uses turntable 50, the bottom of support post 8 is non-rotatably supported. In the exemplary configuration, the lower end of support post 8 is disposed in a cup 60. A locking pin 62 that extends from at least one side of post 8 is received within corresponding slot 64 defined by cup 60 to ensure there is no rotation between support post 8 and support frame 10. The hole cut in floor 14 and the hole defined by pivot disc 16 defines an ear slot(s) that allows support post 8 and pin 62 to be pulled up out of floor 14 when the location of device 2 is changed. In other configurations, the cup and pin arrangement can be reserved with the slot being defined by the lower end of support post 8 and the pin carried by support frame 10.

Cup 60 is carried on the top of support frame 10 that extends across at least two floor joists 12. Support frame 10 is connected to floor joists 12 with four brackets 70 which are bolted to support frame 10 and through bolted to joists 12. Support frame 10 defines a plurality of holes to allow for multiple positions of brackets 70. The openings in brackets 70 are slots to provide for adjustments.

Figure 6:
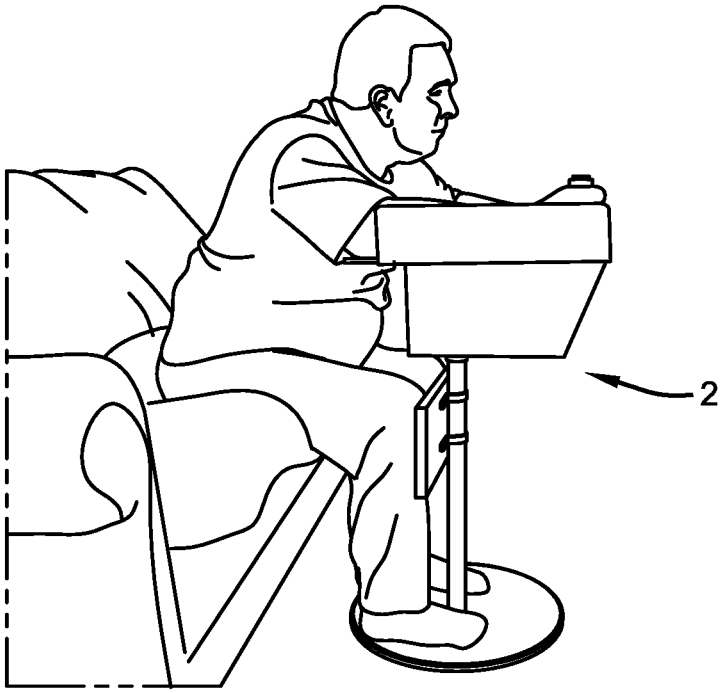
FIG. 6 is a side view of a person initially engaging with the device.
Figure 11:
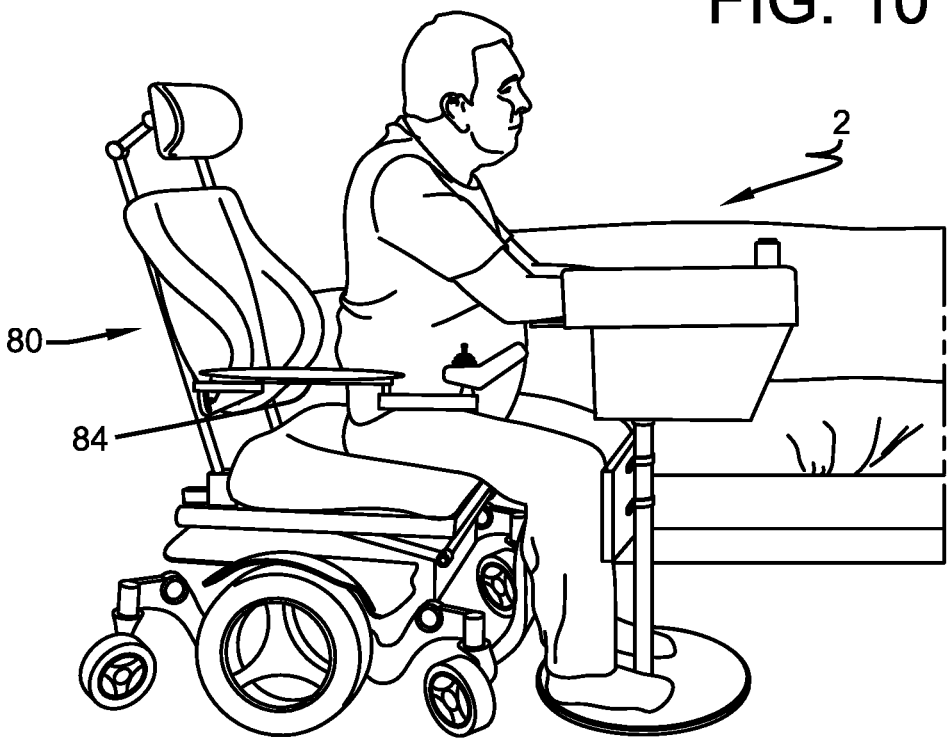
FIG. 11 is a side view of the person seated in the wheelchair with the foot rests removed.
Figure 12:
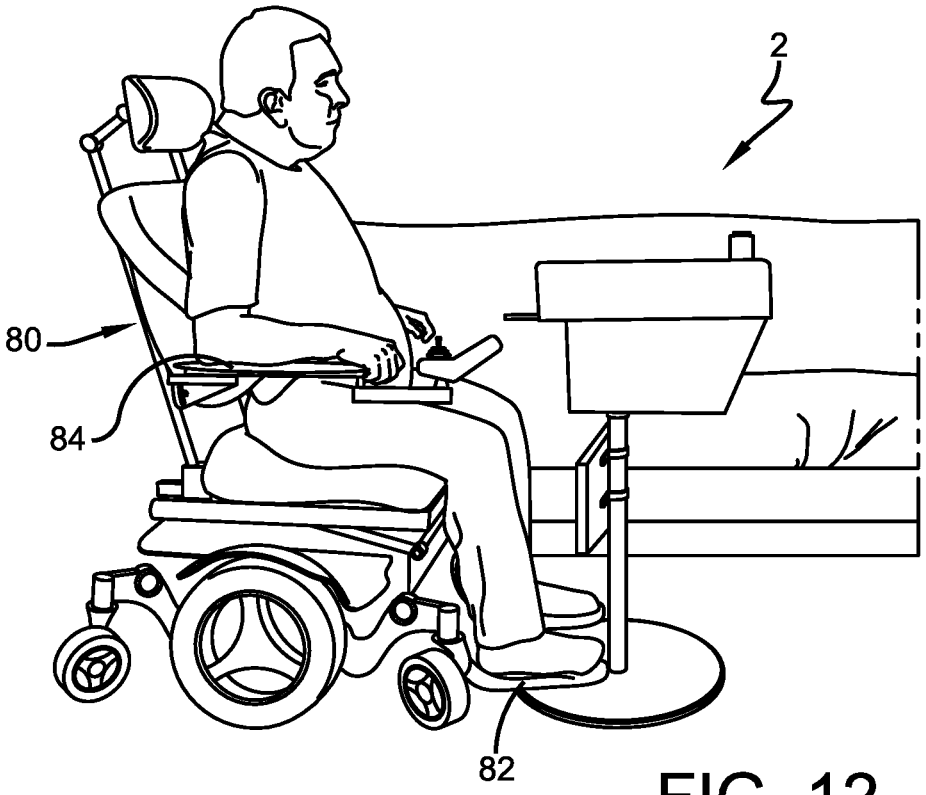
FIG. 12 is a side view of the person seated in the wheel chair with the foot rests installed and in use.

Device 2 is used by a person and an assistant to transfer the person from a first seated position at a first location shown in FIGS. 6 and 7 to a second seated position such as in the wheelchair 80 of FIGS. 11 and 12. The method includes the step of moving wheelchair 80 up to transfer device 2 and moving or removing the footrests 82 of wheelchair 80. The arm rests 84 of wheelchair 80 are lifted and the wheelchair brakes are engaged. The person who is being transferred places his feet on pivot disc 16 while placing his arms at one of the positions 28 or 30 defined by the upper arm support 4. The person then grasps the hand grips 32 or 34 and places his knees against knee board 6. The person then pulls himself up just enough to lift himself up off the chair/couch/bed while an assistant swivels device 2 and the person to a position aligned with wheelchair 80. The person lowers himself onto wheelchair 80. Armrests 84 are lowered, the brake is disengaged, and wheelchair 80 is moved away from transfer device 2. The assistant or the person can then replace footrests 82.

Transfer device 2 can be moved to another location in the person's house where another support frame 10 and cup 60 have been installed with a hole cut in floor 14. The upper portions 4, 6, 8, and 16 are moved to the new location with pivot disc 16 being placed over the hole in floor 14. Support post 8 is then pushed down through the hole to engage cup 60. Device 2 is then ready to use again at the new location.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration of the invention is an example and the invention is not limited to the exact details shown or described. Modifications and alterations of those embodiments will be apparent to one who reads and understands this general description. The present disclosure should be construed as including all such modifications and alterations insofar as they come within the scope of the appended claims or equivalents thereof. Throughout the description and claims of this specification the words "comprise" and "include" as well as variations of those words, such as "comprises," "includes," "comprising," and "including" are not intended to exclude additives, components, integers, or steps.

The invention claimed is:

1. A transfer device used to help a person move from one seated position at a first location to another seated position at a second location within a room having a floor; the floor disposed above at least first and second floor joists; the transfer device comprising:

a support frame connected to the first and second floor joists under the floor;

a foot support disposed on the floor; the foot support including an upper layer which is movable with respect to a lower layer;

a first support being removably and replaceably connected to the support frame; the first support extending up through the floor and through the foot support;

an upper body support rotatably carried by the first support; the upper body support having an open central portion and opposed sides; each of the opposed sides having a lower arm support, an upper arm support, and a hand grip; and a knee board rotatably carried on the first support independent of the foot support.

2. The transfer device of claim 1, wherein the knee board has front and back sides with both of the front and back sides being padded so that it can be rotated around the first support to provide first and second useful positions for the knee board.

3. A transfer device used to help a person move from one seated position at a first location to another seated position at a second location within a room having a floor; the floor disposed above at least first and second floor joists; the transfer device comprising:

a support frame adapted to be connected to the first and second floor joists under the floor;

a foot support adapted to be disposed on the floor;

a first support being removably and replaceably connected to the support frame; the first support adapted to extend up through the floor and through the foot support;

an upper body support rotatably carried by the first support; the upper body support having an open central portion and opposed sides; each of the opposed sides having a lower arm support, an upper arm support, and a hand grip;

a knee board rotatably carried on the first support; and wherein the lower arm supports have a common bottom wall and each has a lower outer wall projecting up from the bottom wall.

4. The transfer device of claim 3, wherein the lower outer walls diverge away from each other as they extend up from the bottom wall.

5. The transfer device of claim 3, further comprising a grip bar extending between the two lower outer walls.

6. The transfer device of claim 5, wherein the grip bar is disposed horizontally.

7. The transfer device of claim 3, wherein each of the upper arm supports includes an upper shelf connected to a lower outer wall; each of the upper arm supports also including an upper outer wall extending up from the upper shelf.

8. The transfer device of claim 7, wherein each hand grip extends from one of the upper shelfs.

9. The transfer device of claim 8, wherein the upper outer walls converge towards the hand grips.

10. The transfer device of claim 9, further comprising a hand brake disposed next to one of the hand grips.

11. The transfer device of claim 1, wherein the support frame including body member that supports the first support; the body member extending across at least the first and second floor joists; a plurality of brackets connected to the body member with the brackets to secure the body member to the first and second floor joists.

12. The transfer device of claim 1, wherein the support frame includes a cup that defines a recess and a slot; the first support being disposed in the recess of the cup; and the first support including a pin that extends through the slot of the cup to prevent the first support from rotating with respect to the support frame.

13. The transfer device of claim 1, wherein the first support includes a collar and a support extension connected to and extending up from the collar; the knee board rotatably carried on the support extension above the collar.

14. The transfer device of claim 1, further comprising a turn table disposed between the upper body support and the first support.

15. A transfer device used to help a person move from one seated position at a first location to another seated position at a second location within a room having a floor; the floor disposed above at least first and second floor joists; the transfer device comprising:

a support frame connected to the first and second floor joists under the floor;

a first support being removably and replaceably non-rotatably connected to the support frame; the first support extending up through the floor; and an upper body support rotatably carried by the first support; the upper body support having opposed sides; each of the opposed sides having a hand grip.

16. A transfer device used to help a person move from one seated position at a first location to another seated position at a second location within a room having a floor; the floor disposed above at least first and second floor joists; the transfer device comprising:

a support frame adapted to be connected to the first and second floor joists under the floor;

a first support being removably and replaceably non-rotatably connected to the support frame; the first support adapted to extend up through the floor;

an upper body support rotatably carried by the first support; the upper body support having an open central portion and opposed sides; each of the opposed sides having a lower arm support, an upper arm support, and a hand grip; and wherein the lower arm supports have a common bottom wall and each has a lower outer wall projecting up from the bottom wall and wherein each of the upper arm supports includes an upper shelf connected to a lower outer wall; each of the upper arm supports also including an upper outer wall extending up from the upper shelf.

17. The transfer device of claim 16, wherein the lower outer walls diverge away from each other as they extend up from the bottom wall.

18. The transfer device of claim 16, further comprising a grip bar extending between the two lower outer walls.

19. The transfer device of claim 15, wherein the support frame includes a cup that defines a recess and a slot; the first support being disposed in the recess of the cup; and the first support including a pin that extends through the slot of the cup to prevent the first support from rotating with respect to the support frame.

20. The transfer device of claim 15, wherein the upper body support includes a horizontal grip bar extending between the opposed sides.

* * * * *